US007588083B2

(12) United States Patent
Newman

(10) Patent No.: US 7,588,083 B2
(45) Date of Patent: Sep. 15, 2009

(54) METHOD AND SYSTEM FOR SCANNING TUBING

(75) Inventor: Frederic M. Newman, Midland, TX (US)

(73) Assignee: Key Energy Services, Inc., Houston, TX (US)

( * ) Notice: Subject to any disclaimer, the term of this patent is extended or adjusted under 35 U.S.C. 154(b) by 133 days.

(21) Appl. No.: 11/690,483

(22) Filed: Mar. 23, 2007

(65) Prior Publication Data

US 2008/0035333 A1 Feb. 14, 2008

Related U.S. Application Data

(60) Provisional application No. 60/786,272, filed on Mar. 27, 2006.

(51) Int. Cl.
*E21B 47/09* (2006.01)
*E21B 47/00* (2006.01)
*G01V 3/18* (2006.01)

(52) U.S. Cl. ..... 166/255.1; 175/40; 702/6

(58) Field of Classification Search ..... 166/250.05, 166/64

See application file for complete search history.

(56) References Cited

U.S. PATENT DOCUMENTS

| | | | | |
|---|---|---|---|---|
| 4,393,485 A | | 7/1983 | Redden | |
| 4,545,017 A | | 10/1985 | Richardson | 702/9 |
| 4,660,419 A | | 4/1987 | Derkacs et al. | 73/622 |
| 4,700,142 A | | 10/1987 | Kuckes | 340/853.5 |
| 4,779,201 A | | 10/1988 | Iisuka et al. | 702/10 |
| 4,851,773 A | | 7/1989 | Rothstein | 324/220 |
| 5,043,663 A | * | 8/1991 | Lam | 324/242 |
| 5,051,962 A | | 9/1991 | Eaton | 367/33 |
| 5,193,628 A | | 3/1993 | Hill et al. | 175/45 |
| 5,218,301 A | | 6/1993 | Kuckes | 324/346 |
| 5,237,539 A | | 8/1993 | Selman | 367/69 |

(Continued)

FOREIGN PATENT DOCUMENTS

WO WO 2004/074808 A2 9/2004

OTHER PUBLICATIONS

PCT/US07/64964 International Search Report and Written Opinion of the International Searching Authority, or Declaration—Date of mailing Feb. 22, 2008.

(Continued)

*Primary Examiner*—David J Bagnell
*Assistant Examiner*—Catherine Loikith
(74) *Attorney, Agent, or Firm*—King & Splading LLP

(57) ABSTRACT

An instrument, such as a wall-thickness, rod-wear, or pitting sensor, can monitor tubing as a field service crew extracts the tubing from an oil well or inserts the tubing into the well. A digital system can process data from the instrument to improve the data's fidelity, quality, or usefulness. Digital signal processing can comprise filtering or otherwise manipulating the data to provide refined data that a person or machine can readily interpret. For example, a graphical representation of the refined data can help an operator evaluate whether a segment of tubing is fit for continued service. Processing tubing data can comprise applying a flexible level of filtering, smoothing, or averaging to the data, wherein the level changes based on a criterion or according to a rule. The level can vary in response to a change in tubing speed, noise in the raw data, or some other parameter.

23 Claims, 10 Drawing Sheets

U.S. PATENT DOCUMENTS

| | | | | |
|---|---|---|---|---|
| 5,278,549 | A | 1/1994 | Crawford | 340/853.2 |
| 5,491,668 | A | 2/1996 | Priest | 367/35 |
| 5,548,900 | A | 8/1996 | Hunt-Grubbe | 33/302 |
| 5,626,192 | A | 5/1997 | Connell et al. | 166/255.1 |
| 5,678,643 | A * | 10/1997 | Robbins et al. | 175/45 |
| 5,947,213 | A | 9/1999 | Angle et al. | 175/24 |
| 6,021,093 | A | 2/2000 | Birchak | |
| 6,079,490 | A | 6/2000 | Newman | 166/77.51 |
| 6,209,639 | B1 | 4/2001 | Newman | 166/250.01 |
| 6,285,955 | B1 | 9/2001 | Goldwasser | |
| 6,316,937 | B1 | 11/2001 | Edens | 324/220 |
| 6,347,292 | B1 | 2/2002 | Denny et al. | 702/188 |
| 6,359,434 | B1 | 3/2002 | Winslow et al. | 324/220 |
| 6,377,189 | B1 | 4/2002 | Newman | |
| 6,411,084 | B1 | 6/2002 | Yoo | 324/221 |
| 6,571,634 | B1 | 6/2003 | Bazarov et al. | 73/623 |
| 6,728,638 | B2 | 4/2004 | Newman | 702/5 |
| 6,760,665 | B1 | 7/2004 | Francis | 702/6 |
| 6,896,056 | B2 | 5/2005 | Mendez et al. | 166/254.2 |
| 7,006,920 | B2 | 2/2006 | Newman et al. | 702/6 |
| 7,107,154 | B2 * | 9/2006 | Ward | 702/6 |
| 2004/0226712 | A1 | 11/2004 | Hood et al. | 166/66 |
| 2005/0194182 | A1 | 9/2005 | Rodney et al. | 175/24 |
| 2006/0047430 | A1 * | 3/2006 | Edwards | 702/6 |

OTHER PUBLICATIONS

PCT/US07/64948 International Search Report and Written Opinion of the International Searching Authority, or Declaration—Date of mailing Dec. 17, 2007.

PCT/US07/64894 International Search Report and Written Opinion of the International Searching Authority, or Declaration—Date of mailing Feb. 7, 2008.

PCT/US07/65032 International Search Report and Written Opinion of the International Searching Authority, or Declaration—Date of mailing Jul. 2, 2008.

PCT/US07/64846 International Search Report and Written Opinion of the International Searching Authority, or Declaration—Date of mailing Dec. 12, 2007.

* cited by examiner

| | 1 | 2 | 3 | 4 | 5 | 6 | 7 | 8 | 9 | 10 | Sample Number |
|---|---|---|---|---|---|---|---|---|---|---|---|
| 555 | 10 | 19 | 22 | 19 | 26 | 21 | 15 | 10 | 17 | 26 | Unfiltered samples $S_i$ |
| 560 | X | 14.5 | 20.5 | 20.5 | 22.5 | 23.5 | 18 | 12.5 | 13.5 | 21.5 | Filtered samples $FS_i$ $FS_i = (S_i + S_{i-1})/2$ |
| 565 | X | X | 17 | 20 | 22.3 | 22 | 20.7 | 15.3 | 14 | 17.7 | Filtered samples $FS_i$ $FS_i = (S_i + S_{i-1} + S_{i-2})/3$ |

550

| | 1 | 2 | 3 | 4 | 5 | 6 | 7 | 8 | 9 | 10 | Sample Number |
|---|---|---|---|---|---|---|---|---|---|---|---|
| 555 | 10 | 19 | 22 | 19 | 26 | 21 | 15 | 10 | 17 | 26 | Unfiltered samples $S_i$ |
| 760 | X | 17.2 | 21.4 | 19.6 | 24.6 | 22 | 16.2 | 11 | 15.6 | 24.2 | Filtered samples $FS_i$ $FS_i = .8Si + .2S_{i-1}$ |
| 765 | X | X | X | 19 | 22.4 | 22.2 | 19.4 | 15.3 | 14.9 | 19 | Filtered samples $FS_i$ $FS_i = .4S_i + .3S_{i-1} + .2S_{i-2} + .1S_{i-3}$ |

750

METHOD AND SYSTEM FOR SCANNING TUBING

This application claims benefit of U.S. Provisional Application Ser. No. 60/786,272, filed on Mar. 27, 2006.

FIELD OF THE INVENTION

The present invention relates to determining a physical property of a tube that is being inserted into or extracted from an oil well and more specifically to processing information from a tubing scanner using an adaptive or tunable filter implemented via digital signal processing.

BACKGROUND

After drilling a hole through a subsurface formation and determining that the formation can yield an economically sufficient amount of oil or gas, a crew completes the well. During drilling, completion, and production maintenance, personnel routinely insert and/or extract devices such as tubing, tubes, pipes, rods, hollow cylinders, casing, conduit, collars, and duct into the well. For example, a service crew may use a workover or service rig to extract a string of tubing and sucker rods from a well that has been producing petroleum. The crew may inspect the extracted tubing and evaluate whether one or more sections of that tubing should be replaced due physical wear, thinning of the tubing wall, chemical attack, pitting, or another defect. The crew typically replaces sections that exhibit an unacceptable level of wear and notes other sections that are beginning to show wear and may need replacement at a subsequent service call.

As an alternative to manually inspecting tubing, the service crew may deploy an instrument to evaluate the tubing as the tubing is extracted from the well and/or inserted into the well. The instrument typically remains stationary at the wellhead, and the workover rig moves the tubing through the instrument's measurement zone.

The instrument typical measures pitting and wall thickness and can identify cracks in the tubing wall. Radiation, field strength (electrical, electromagnetic, or magnetic), sonic/ultrasonic pulses, and/or pressure differential may interrogate the tubing to evaluate these wear parameters. The instrument typically produces a raw analog signal and outputs a sampled or digital version of that analog signal.

In other words, the instrument, typically stimulates a section of the tubing using a field, radiation, or pressure and detects the tubing's interaction with or response to the stimulus. An element, such as a transducer, converts the response into an analog electrical signal. For example, the instrument may create a magnetic field into which the tubing is disposed, and the transducer may detect changes or perturbations in the field resulting from the presence of the tubing and any anomalies of that tubing.

The analog electrical signal output by the transducer can have an arbitrary or essentially unlimited number of states or measurement possibilities. That is, rather than having two discrete or binary levels, typical transducers produce signals that can assume any of numerous levels or values. As the tubing passes through the measurement field of the instrument, the analog transducer signal varies in response to variations and anomalies in the wall of the moving tubing.

The transducer and its associated electronics may have a dampened or lagging response that tends to reduce the responsiveness of the signal to tubing wall variations and/or noise. In other words, the instrument may acquire and process analog signals in a manner that steadies or stabilizes those analog signals. In typical conventional instruments, the analog processing remains fixed. That is, any damping or filtering of those signals is generally constant and inflexible.

The instrument also typically comprises a system, such as an analog-to-digital converter ("ADC"), that converts the analog transducer signal into one or more digital signals suited for reception and display by a computer. In conventional instruments, those digital signals typically provide a "snapshot" of the transducer signal. Thus, the ADC typically outputs a number, or set of a numbers, that represents or describes the analog transducer signal at a certain instant or moment in time. Since the analog transducer signal describes the section of tubing that is in the instrument's measurement zone, the digital signal is effectively a sample or a snapshot of a parameter-of-interest of that tubing section.

The analog-to-digital conversion typically occurs on a fixed-time basis, for example one, eight, or sixteen times per second. That is, conventional instruments usually acquire measurement samples at a predetermined rate or on a fixed time interval. Meanwhile, the speed of the tubing passing through the measurement zone often fluctuates or changes erratically. That is, the operator and rig may change the extraction speed in an unrepeatable fashion or in a manner that is not known in advance, a priori, or before the speed-change event.

Thus, the instrument may output a series of samples or digital snapshots with each sample separated by a tubing length that is not readily determined using conventional technology. The separation between samples might be a millimeter, a centimeter, or a meter of tubing length, for example. The distance between samples may vary, fluctuate, or change erratically as the operator changes the tubing speed. Moreover, the sample data may blur or become smeared when the tubing is moving rapidly. Consequently, fixing the time interval between each snapshot and allowing the tubing speed to vary between snapshots, as occurs in most conventional instruments, can produce data that is difficult to interpret or that fails to adequately characterize the tubing.

Another shortcoming of conventional instruments is that they generally provide an insufficient or limited level of processing of the digital samples. When the tubing is moving slowly through the instrument's measurement zone or is stationary, an operator may incorrectly interpret variation in the digital samples as a wall defect; however, the variation may actually result from signal noise. In other words, at slow tubing speeds, signal spikes due to noise or a random event can be mistaken for a defective tubing condition.

Meanwhile, when the tubing is moving quickly through the measurement zone, the tubing motion may blur or smooth signal spikes that are actually due to tubing defects, thereby hiding those defects from operator observation. That is, with conventional instruments, high-speed tubing motion may mask or obscure tubing wall defects. This phenomenon can be likened to the image blurring that can occur when a person takes a photograph of a fast moving car.

To address these representative deficiencies in the art, what is needed is an improved capability for evaluating tubing, for example in a petroleum application wherein the tubing is being placed into or drawn from an oil well. A further need exists for processing digital signals, samples, or snapshots of a physical parameter of the tubing. A further need exists for an instrument that can apply a flexible level of processing, filtering, or averaging to a signal from an instrument that is scanning or evaluating the tubing. Yet another need exists for processing instrumentation signals in a manner that smoothes noise while preserving signal structure indicative of valid tubing defects. Still another need exists for converting analog instrumentation or transducer signals into digital signals while accounting or compensating for changes in tubing speed. A capability addressing one or more of these needs would provide more accurate, precise, repeatable, efficient, or profitable tubing evaluations.

SUMMARY OF THE INVENTION

The present invention supports evaluating an item, such as a piece of tubing or a rod, in connection with placing the item into an oil well or removing the item from the oil well. Evaluating the item can comprise sensing, scanning, monitoring, inspecting, assessing, or detecting a parameter, characteristic, or property of the item.

In one aspect of the present invention, an instrument, scanner, or sensor can monitor tubing, tubes, pipes, rods, hollow cylinders, casing, conduit, collars, or duct near a wellhead of the oil well. The instrument can comprise a wall-thickness, rod-wear, collar locating, crack, imaging, or pitting sensor, for example. As a field service crew extracts tubing from the oil well or inserts the tubing into the well, the instrument can evaluate the tubing for defects, integrity, wear, fitness for continued service, or anomalous conditions. The instrument can provide tubing information in a digital format, for example as digital data, one or more numbers, samples, or snapshots. The instrument can digitally process acquired data to improve the data's fidelity, quality, or usefulness. Subjecting the tubing data to digital signal processing ("DSP") can promote data interpretation, for example to help a person or a machine better evaluate whether the tubing is acceptable for installation in the oil well. Processing tubing data can comprise applying a flexible level of filtering, smoothing, or averaging to the data, wherein the level changes based on a criterion or according to a rule. The level can vary in response to a change in tubing speed, noise in the raw data, or some other parameter. For example, the instrument can suppress or attenuate signal variations associated with or attributable to noise, random events, or conditions that typically have little or no direct correlation to valid tubing defects. Meanwhile, the instrument can process signals in a manner that preserves signal structures, spikes, or amplitude changes, that are indicative of actual tubing defects.

The discussion of processing tubing data presented in this summary is for illustrative purposes only. Various aspects of the present invention may be more clearly understood and appreciated from a review of the following detailed description of the disclosed embodiments and by reference to the drawings and any claims that may follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by any accompanying claims.

BRIEF DESCRIPTION OF THE DRAWINGS

FIG. 3, are a flowchart of an exemplary process for obtaining information about tubing that is being inserted into or extracted from an oil well in accordance with an embodiment of the present invention.

FIG. 5, are a graphical plot and an accompanying table of exemplary raw and filtered data samples in accordance with an embodiment of the present invention.

FIG. 7, are a graphical plot and an accompanying table of tubing data filtered with an exemplary adaptive filter in accordance with an embodiment of the present invention.

Figure 1:
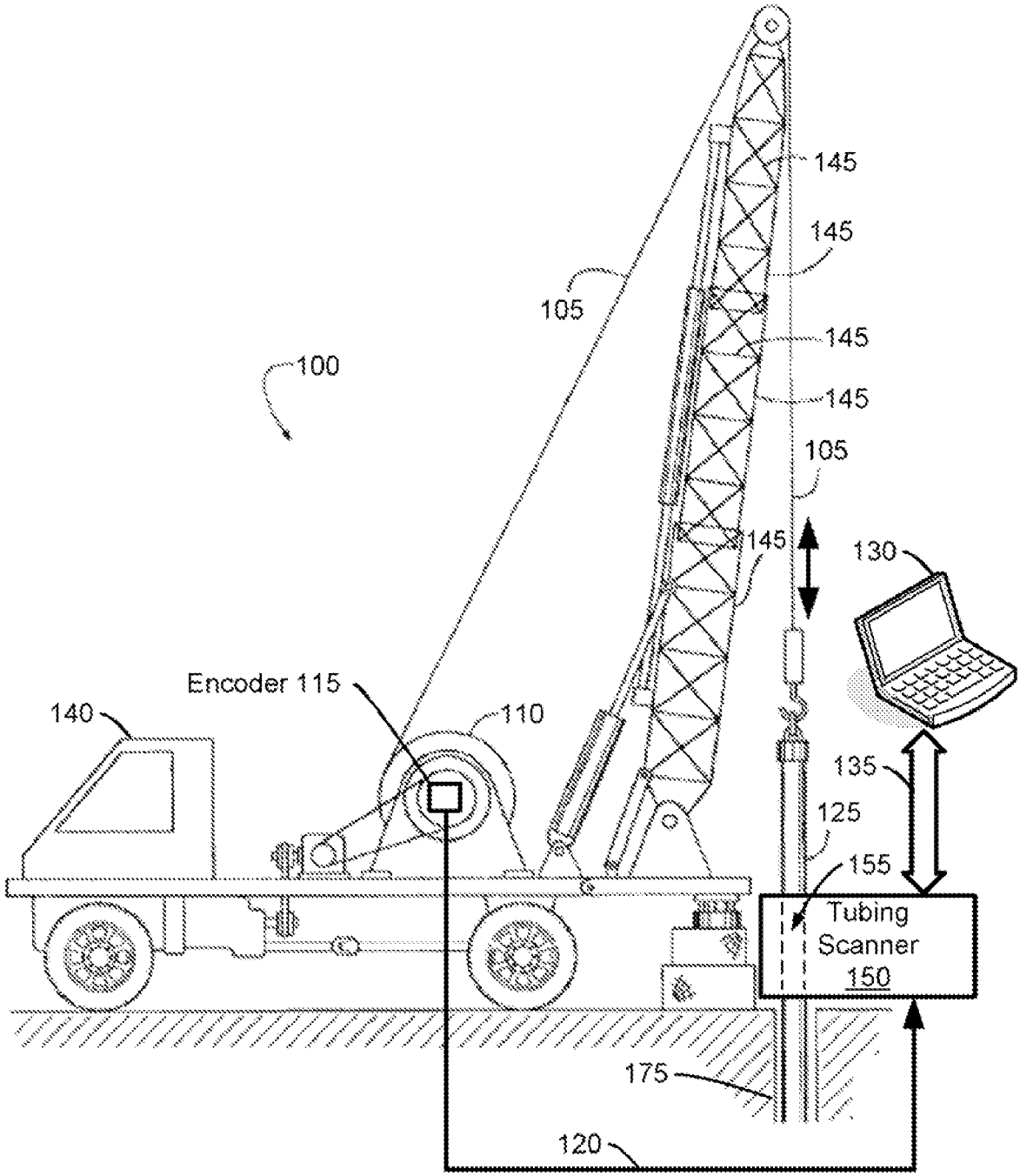
FIG. 1 is an illustration of an exemplary system for servicing an oil well that scans tubing as the tubing is extracted from or inserted into the well in accordance with an embodiment of the present invention.

Many aspects of the invention can be better understood with reference to the above drawings. The components in the drawings are not necessarily to scale, emphasis instead being placed upon clearly illustrating the principles of exemplary embodiments of the present invention. Moreover, in the drawings, reference numerals designate like or corresponding, but not necessarily identical, elements throughout the several views.

DETAILED DESCRIPTION OF EXEMPLARY EMBODIMENTS

The present invention supports processing information or data that describes or characterizes a tubing parameter, such as pitting, wall thickness, wall cracks, or some other indication of tubing quality or integrity. Processing tubing data can enhance the utility, usefulness, or fidelity of the data, for example helping determine whether a piece of tubing remains fit for continued service. Thus, an oilfield service crew can make efficient, accurate, or sound evaluations of how much life, if any, remains in each joint of tubing in a string of tubing.

Figure 2:
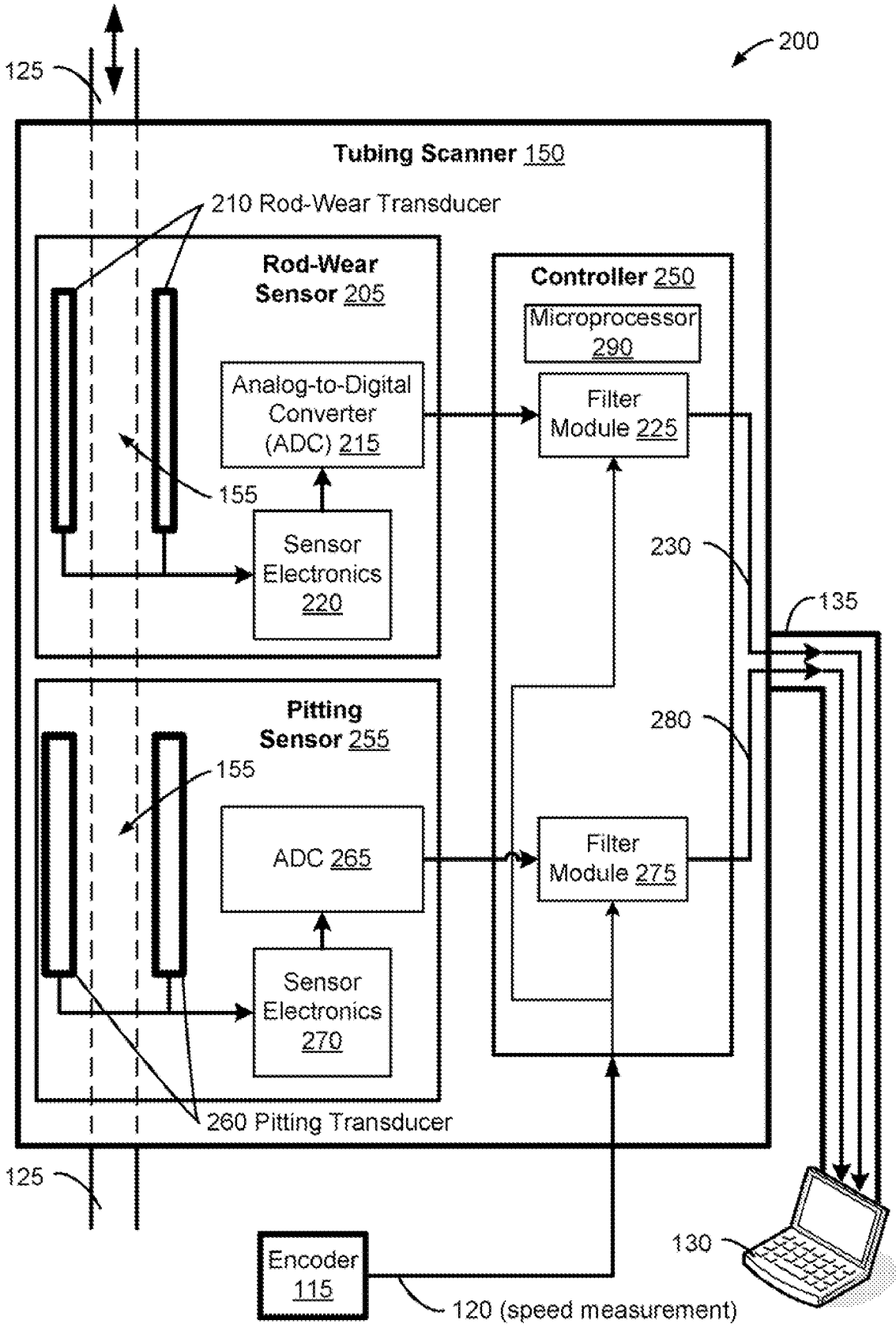
FIG. 2 is a functional block diagram of an exemplary system for scanning tubing that is being inserted into or extracted from an oil well in accordance with an embodiment of the present invention.

A method and system for processing tubing data will now be described more fully hereinafter with reference to FIGS. 1-9, which show representative embodiments of the present invention. FIG. 1 depicts a workover rig moving tubing through a tubing scanner in a representative operating environment for an embodiment the present invention. FIG. 2 provides a block diagram of a tubing scanner that monitors, senses, or characterizes tubing and flexibly processes acquired tubing data. FIGS. 3-9 show flow diagrams, along with illustrative data and plots, of methods related to acquiring tubing data and processing acquired data.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting, and among others supported by representations of the present invention.

Moreover, although an exemplary embodiment of the invention is described with respect to sensing or monitoring a tube, tubing, or pipe moving though a measurement zone adjacent a wellhead, those skilled in the art will recognize that the invention may be employed or utilized in connection with a variety of applications in the oilfield or another operating environment.

Turning now to FIG. 1, this figure illustrates a system 100 for servicing an oil well 175 that scans tubing 125 as the tubing 125 is extracted from or inserted into the well 175 according to an exemplary embodiment of the present invention.

The oil well 175 comprises a hole bored or drilled into the ground to reach an oil-bearing formation. The borehole of the well 175 is encased by a tube or pipe (not explicated shown in FIG. 1), known as a "casing," that is cemented to down-hole formations and that protects the well from unwanted formation fluids and debris.

Within the casing is a tube 125 that carries oil, gas, hydrocarbons, petroleum products, and/or other formation fluids, such as water, to the surface. In operation, a sucker rod string (not explicitly shown in FIG. 1), disposed within the tube 125, forces the oil uphole. Driven by strokes from an uphole machine, such as a "rocking" pump jack, the sucker rod moves up and down to communicate reciprocal motion to a downhole pump (not explicitly shown in FIG. 1). With each stroke, the downhole pump moves oil up the tube 125 towards the wellhead.

As shown in FIG. 1, a service crew uses a workover or service rig 140 to service the well 175. During the illustrated procedure, the crew pulls the tubing 125 from the well, for example to repair or replace the downhole pump. The tubing 125 comprises a string of sections, each of which may be referred to as a "joint," that typically range in length from 29 to 34 feet (about 8.8 to 10.3 meters). The joints screw together via unions, tubing joints, or threaded connections.

The crew uses the workover rig 140 to extract the tubing 125 in increments or steps, typically two joints per increment. The rig 140 comprises a derrick or boom 145 and a cable 105 that the crew temporarily fastens to the tubing string 125. A motor-driven reel 110, drum, winch, or block and tackle pulls the cable 105 thereby hoisting or lifting the tubing string 125 attached thereto. The crew lifts the tubing string 125 a vertical distance that approximately equals the height of the derrick 145, typically about sixty feet or two joints.

More specifically, the crew attaches the cable 105 to the tubing string 125, which is vertically stationary during the attachment procedure. The crew then lifts the tubing 125, generally in a continuous motion, so that two joints are extracted from the well 175 while the portion of the tubing string 125 below those two joints remains in the well 175. When those two joints are out of the well 175, the operator of the reel 110 stops the cable 105, thereby halting upward motion of the tubing 125. The crew then separates or unscrews the two exposed joints from the remainder of the tubing string 125 that extends into the well 175. A clamping apparatus grasps the tubing string 125 while the crew unscrews the two exposed joints, thereby preventing the string 125 from dropping into the well 175 when those joints separate from the main string 125.

The crew repeats the process of lifting and separating two-joint sections of tubing from the well 175 and arranges the extracted sections in a stack of vertically disposed joints, known as a "stand" of tubing. After extracting the full tubing string 125 from the well 175 and servicing the pump, the crew reverses the step-wise tube-extraction process to place the tubing string 125 back in the well 175. In other words, the crew uses the rig 140 to reconstitute the tubing string 125 by threading or "making up" each joint and incrementally lowering the tubing string 125 into the well 175.

The system 100 comprises an instrumentation system for monitoring, scanning, assessing, or evaluating the tubing 125 as the tubing 125 moves into or out of the well 175. The instrumentation system comprises a tubing scanner 150 that obtains information or data about the portion of the tubing 125 that is in the scanner's sensing or measurement zone 155. Via a data link 120, an encoder 115 provides the tubing scanner 150 with speed, velocity, and/or positional information about the tube 125. That is, the encoder 115 is mechanically linked to the reel 110 to determine motion and/or position of the tubing 125 as the tubing 125 moves through the measurement zone 155.

As an alternative to the illustrated encoder 115, some other form of positional or speed sensor can determine the derrick's block speed or the rig engine's rotational velocity in revolution per minute ("RPM"), for example.

Another data link 135 connects the tubing scanner 150 to a computing device, which can be a laptop 130, a handheld, a personal communication device ("PDA"), a cellular system, a portable radio, a personal messaging system, a wireless appliance, or a stationary personal computer ("PC"), for example. The laptop 130 displays data that the tubing scanner 150 has obtained from the tubing 125. The laptop 130 can present the tubing data graphically, for example in a trend format. The service crew monitors or observes the displayed data on the laptop 130 to evaluate the condition of the tubing 125. The service crew can thereby grade the tubing 125 according to its fitness for continued service, for example.

The communication link 135 can comprise a direct link or a portion of a broader communication network that carries information among other devices or similar systems to the system 100. Moreover, the communication link 135 can comprise a path through the Internet, an intranet, a private network, a telephony network, an Internet protocol ("IP") network, a packet-switched network, a circuit-switched network, a local area network ("LAN"), a wide area network ("WAN"), a metropolitan area network ("MAN"), the public switched telephone network ("PSTN"), a wireless network, or a cellular system, for example. The communication link 135 can further comprise a signal path that is optical, fiber optic, wired, wireless, wire-line, waveguided, or satellite-based, to name a few possibilities. Signals transmitting over the link 135 can carry or convey data or information digitally or via analog transmission. Such signals can comprise modulated electrical, optical, microwave, radiofrequency, ultrasonic, or electromagnetic energy, among other energy forms.

The laptop 130 typically comprises hardware and software. That hardware may comprise various computer components, such as disk storage, disk drives, microphones, random access memory ("RAM"), read only memory ("ROM"), one or more microprocessors, power supplies, a video controller, a system bus, a display monitor, a communication interface, and input devices. Further, the laptop 130 can comprise a digital controller, a microprocessor, or some other implementation of digital logic, for example.

The laptop 130 executes software that may comprise an operating system and one or more software modules for managing data. The operating system can be the software product that Microsoft Corporation of Redmond, Wash. sells under the registered trademark WINDOWS, for example. The data management module can store, sort, and organize data and can also provide a capability for graphing, plotting, charting, or trending data. The data management module can be or comprise the software product that Microsoft Corporation sells under the registered trademark EXCEL, for example.

In one exemplary embodiment of the present invention, a multitasking computer functions as the laptop 130. Multiple programs can execute in an overlapping timeframe or in a manner that appears concurrent or simultaneous to a human observer. Multitasking operation can comprise time slicing or timesharing, for example.

The data management module can comprise one or more computer programs or pieces of computer executable code. To name a few examples, the data management module can comprise one or more of a utility, a module or object of code, a software program, an interactive program, a "plug-in" an "applet," a script, a "scriptlet," an operating system, a browser, an object handler, a standalone program, a language, a program that is not a standalone program, a program that runs a computer, a program that performs maintenance or general purpose chores, a program that is launched to enable a machine or human user to interact with data, a program that creates or is used to create another program, and a program that assists a user in the performance of a task such as database interaction, word processing, accounting, or file management.

Turning now to FIG. 2, this figure illustrates a functional block diagram of a system 200 for scanning tubing 125 that is being inserted into or extracted from an oil well 175 according to an exemplary embodiment of the present invention. Thus, the system 200 provides an exemplary embodiment of the instrumentation system shown in FIG. 1 and discussed above, and will be discussed as such.

Those skilled in the information-technology, computing, signal processing, sensor, or electronics arts will recognize that the components and functions that are illustrated as individual blocks in FIG. 2, and referenced as such elsewhere herein, are not necessarily well-defined modules. Furthermore, the contents of each block are not necessarily positioned in one physical location. In one embodiment of the present invention, certain blocks represent virtual modules, and the components, data, and functions may be physically dispersed. Moreover, in some exemplary embodiments, a single physical device may perform two or more functions that FIG. 2 illustrates in two or more distinct blocks. For example, the function of the personal computer 130 can be integrated into the tubing scanner 150 to provide a unitary or commonly-housed hardware and software element that acquires and processes data and displays processed data in graphical form for viewing by an operator, technician, or engineer.

The tubing scanner 150 comprises a rod-wear sensor 205 and a pitting sensor 255 for determining parameters relevant to continued use of the tubing 125. The rod-wear sensor 205 assesses relatively large tubing defects or problems such as wall thinning. Wall thinning may be due to physical wear or abrasion between the tubing 125 and the sucker rod that is reciprocates therein, for example. Meanwhile, the pitting sensor 255 detects or identifies smaller flaws, such as pitting stemming from corrosion or some other form of chemical attack within the well 175. Those small flaws may be visible to the naked, eye or may have microscopic features, for example. Pitting can occur on the inside surface of the tubing 125, the so-called "inner diameter," or on the outside of the tubing 125.

The inclusion of the rod-wear sensor 205 and the pitting sensor 255 in the tubing scanner 150 is intended to be illustrative rather than limiting. The tubing scanner 150 can comprise another sensor or measuring apparatus that may be suited to a particular application. For example, the instrumentation system 200 can comprise a collar locator, a device that detects tubing cracks or splits, a temperature gauge, a camera, a hydrostatic fester, etc. In one exemplary embodiment of the present invention, the scanner 150 comprises or is coupled to an inventory counter, such as one of the inventory counting devices disclosed in U.S. Patent Application Publication Number 2004/0196032.

The tubing scanner 150 also comprises a controller 250 that processes signals from the rod-wear sensor 205 and the pitting sensor 255. The exemplary controller 250 has two filter modules 225, 275 that each, as discussed in further detail below, adaptively or flexibly processes sensor signals. In one exemplary embodiment, the controller 250 processes signals according to a speed measurement from the encoder 115.

The controller 250 can comprise a computer, a microprocessor 290, a computing device, or some other implementation of programmable or hardwired digital logic. In one exemplary embodiment, the controller 250 comprises one or more application specific integrated circuits ("ASICS") or DSP chips that perform the functions of the filters 225, 275, as discussed below. The filter modules 225, 275 can comprise executable code stored on ROM, programmable ROM ("PROM"), RAM, an optical disk, a hard drive, magnetic media, tape, paper, or some other machine readable medium.

The rod-wear sensor 205 comprises a transducer 210 that outputs an electrical signal containing information about the section of tubing 125 that is in the measurement zone 155. As discussed above, the transducer 210 typically responds to the flux density or flux uniformity in the measurement zone 155 adjacent the tube 125. Sensor electronics 220 amplify or condition that output, signal and feed the conditioned signal to the ADC 215. The ADC 215 converts the signal into a digital format, typically providing samples or snapshots of the wall thickness of the portion of the tubing 125 that is situated in the measurement zone 155.

The rod-wear filter module 225 receives the samples or snapshots from the ADC 215 and digitally processes those signals to facilitate machine- or human-based signal interpretation. The communication link 135 carries the digitally processed signals 230 from the rod-wear filter module 225 to the laptop 130 for recording and/or review by one or more members of the service crew. The service crew can observe the processed data to evaluate the suitability of the tubing 125 for ongoing service.

Similar to the rod-wear sensor 205, the pitting sensor 255 comprises a pitting transducer 260, sensor electronics 270 that amplify the transducer's output, and an ADC 265 for digitizing and/or sampling the amplified signal from the sensor electronics 270. Like the rod-wear filter module 225, the pitting filter module 275 digitally processes measurement samples from the ADC 265 and outputs a signal 280 that exhibits improved signal fidelity for display on the laptop 130.

Each of the transducers 210, 260 generates a stimulus and outputs a signal according to the tubing's response to that stimulus. For example, one of the transducers 210, 260 may generate a magnetic field and detect the tubing's effect or distortion of that field. In one exemplary embodiment, the pitting transducer 260 comprises field coils that generate the magnetic field and Hall effect sensors or magnetic "pickup" coils that detect field strength.

In one exemplary embodiment, one of the transducers 210, 260 may output ionizing radiation, such as gamma rays, incident upon the tubing 125. The tubing 125 blocks or deflects a fraction of the radiation and allows transmission of another portion of the radiation. In this example, one or both of the transducers 210, 260 comprises a detector that outputs an electrical signal with a strength or amplitude that changes according to the number of gamma rays detected. The detector may count individual gamma rays by outputting a discrete signal when a gamma ray interacts with the detector, for example. Ultrasonic or sonic energy can also be used to probe the tubing 125.

Processes of exemplary embodiments of the present invention will now be discussed with reference to FIGS. 3-9. An exemplary embodiment of the present invention can comprise one or more computer programs or computer-implemented methods that implement functions or steps described herein and illustrated in the exemplary flowcharts, graphs, and data sets of FIGS. 3-9 and the diagrams of FIGS. 1 and 2. However, it should be apparent that there could be many different ways of implementing the invention in computer programming, and the invention should not be construed as limited to any one set of computer program instructions. Further, a skilled programmer would be able to write such a computer program to implement the disclosed invention without difficulty based on the exemplary system architectures, data tables, data plots, and flowcharts and the associated description in the application text, for example.

Therefore, disclosure of a particular set of program code instructions is not considered necessary for an adequate understanding of how to make and use the invention. The inventive functionality of any claimed process, method, or computer program will be explained in more detail in the following description in conjunction with the remaining figures illustrating representative functions and program flow.

Certain steps in the processes described below must naturally precede others for the present invention to function as described. However, the present invention is not limited to the order of the steps described if such order or sequence does not alter the functionality of the present invention in an undesirable manner. That is, it is recognized that some steps may be performed before or after other steps or in parallel with other steps without departing from the scope and spirit of the present invention.

Figure 3A:
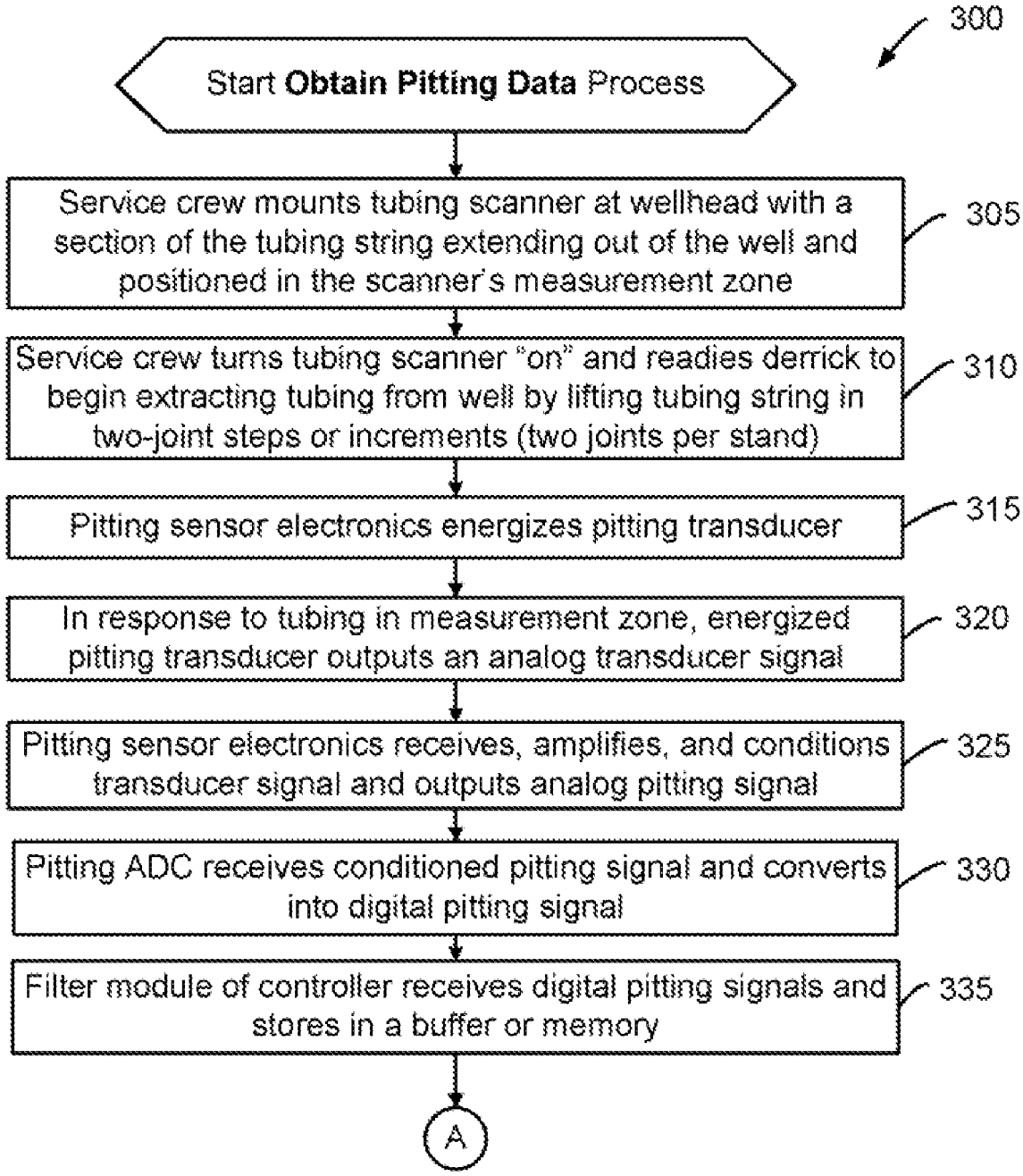
FIGS. 3A and 3B, collectively
Figure 3B:
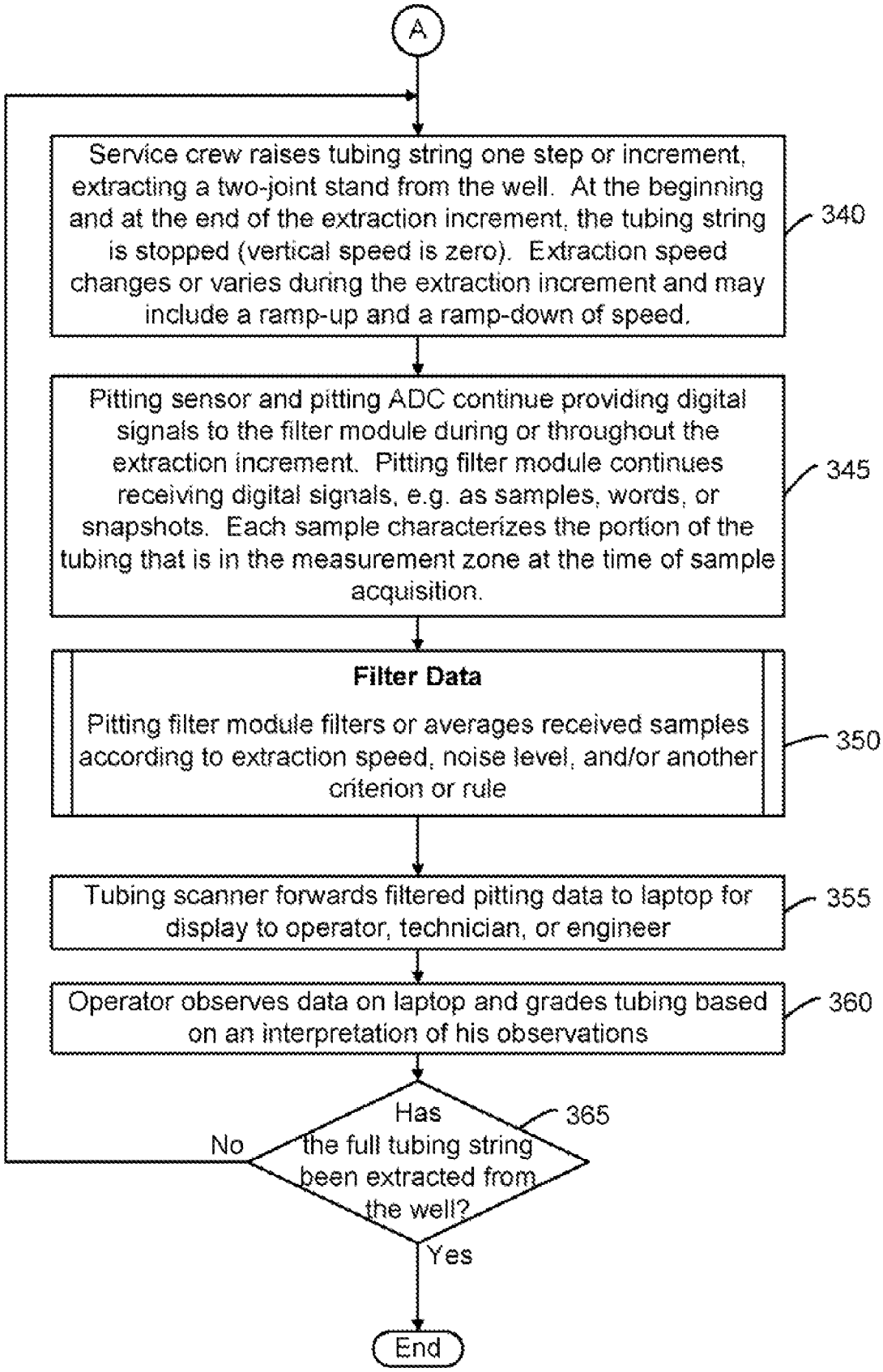

Turning now to FIG. 3, this two-part figure illustrates a flowchart of a process 300 for obtaining information about tubing 125 that is being inserted into or extracted from an oil well 175 according to an exemplary embodiment of the present invention. While Process 300, which is entitled Obtain Pitting Data, describes conducting a tubing evaluation using the pitting sensor 225, the underlying method can be applied to various sensors and monitoring devices, including the rod-wear sensor 205 shown in FIG. 2 and discussed above.

At Step 305, the oil field service crew arrives at the well site with the tubing scanner 150 and the workover rig 140. The crew places the tubing scanner 150 at the wellhead, typically via a detachable mount, and locates the derrick 145 over the well 175. As illustrated in FIG. 1, a portion of the tubing 125 is disposed in the measurement zone 155 of the tubing scanner 150, while another portion, suspended below, extends in to the well 175.

At Step 310, the service crew applies power to the tubing scanner 150 or turns it "on" and readies the derrick 145 to begin lifting the tubing string 125 out of the well 175 in two-joint steps or increments.

At Step 315, the pitting sensor electronics 270 receives electrical energy from a power source (not explicitly shown in FIG. 2) and, in turn, supplies electrical energy to the pitting transducer 260. The pitting transducer 260 generates a magnetic field with flux lines through the wall of the tubing 125, running generally parallel to the longitudinal axis of the tubing 125.

At Step 320, the pitting transducer 260 outputs an electrical signal based on the tubing's presence in the sensor's measurement zone 155. More specifically, Hall effect sensors, magnetic field-strength detectors, or pickup coils measure magnetic field strength at various locations near the tubing 125. The electrical signal, which may comprise multiple distinct signals from multiple detectors, carries information about the tubing wall. More specifically, the intensity of the transducer signal correlates to the amount of pitting of the section of the tubing 125 that is in the measurement zone 155. The output signal is typically analog, implying that, it can have or assume an arbitrary or virtually unlimited number of states or intensity values.

At Step 325, the pitting sensor electronics 270 receives the analog signal from the pitting transducer 260. The electronics 270 conditions the signal for subsequent processing, typically via applying amplification or gain to heighten signal, intensity and/or to create a more robust analog signal.

At Step 330, the ADC 265 receives the conditioned analog signal from the sensor electronics 270 and generates a corresponding digital signal. The digitization process creates a digital or discrete signal that is typically represented by one or more numbers. The ADC 265 generally operates on a time basis, for example outputting one digital signal per second, sixteen per second, or some other number per second or minute, such as 10, 32, 64, 100, 1000, 10,000, etc. The ADC 265 can be viewed as sampling the analog signal from the transducer 260 at a sample rate. Each output signal or sample can comprise bits transmitted on a single line or on multiple lines, for example serially or in a parallel format.

Each digital output from the ADC 265 can comprise a sample or snapshot of the transducer signal or of the extent of pitting of the tubing 125. Thus, the ADC 265 provides measurement samples at predetermined time intervals, on a repetitive or fixed-time basis, for example.

In one exemplary embodiment of the present invention, the ADC 265 provides functionality beyond a basic conversion of analog signals into the digital domain. For example, the ADC 265 may handle multiple digital samples and process or average those samples to output a burst or package of data. Such a data package can comprise a snapshot or a sample of tubing pitting, for example.

Thus, in one exemplary embodiment, the ADC 265 outputs a digital word at each sampling interval, wherein each word comprises a measurement of the signal intensity of the ADC's analog input. As discussed below, the filter module 275 filters or averages those words. And in the alternative exemplary embodiment, the ADC 265 not only implements the analog-to-digital conversion, but also performs at least some processing of the resulting digital words. That processing can comprise accumulating, aggregating, combining, or averaging multiple digital words and feeding the result to the filter module 275. The filter module 275, in turn, processes the results output from the ADCs 265, for example via adaptive filtering.

At Step 335, the pitting filter module 275 of the controller 250 receives the digital signals from the ADC 265 and places those signal in memory, for example a short-term memory, a long-term memory, one or more RAM registers, or a buffer. As discussed above, the pitting filter module 275 typically comprises executable instructions or software.

Thus, while the tubing 125 remains vertically stationary in the measurement zone 155 of the pitting sensor 255, the ADC 265 provides a series or steam of digital samples, typically aligned on a recurring timeframe.

At Step 340, the service crew raises the tubing string 125 to expose two joints or thirty-foot pieces of tubing 125 from the well 175. The service crew stops the vertical motion of the tubing 125 when the two joints are sufficiently out of the well 175 to facilitate separation of those joints from the full tubing string 125.

The service crew typically lifts the tubing string 125 in a continuous motion, keeping the tubing string 125 moving upward until the two joints have achieved an acceptable height above the wellhead. In other words, in one increment of tube extraction, the tubing string 125 starts at a rest, progresses upward with continuous, but not necessarily uniform or smooth, motion and ends at a rest. The upward motion during the increment may contain speed variations, fluctuations, or perturbations. In each step, the operator of the reel 110 may apply a different level of acceleration or may achieve a different peak speed. The operator may increase and decrease the speed in ramp-up/ramp-down fashion, for example.

At Step 345, the pitting sensor ADC 265 continues outputting digital samples to the pitting filter module 275. Thus, the pitting sensor 255 can output digitally formatted measurements at regular time intervals. In one exemplary embodiment, the duration of each interval can remain fixed while the extraction speed changes and while the tubing's progress ceases between each extraction increment. In one exemplary embodiment, the ADC 265 continues outputting samples whether the tubing 125 is moving or is stopped.

At Step 350, the pitting filter module 275 filters or averages the samples that it receives from the pitting ADC 265. The pitting filter module 275 can implement the filtering via DSP or some other form of processing the signals from the pitting sensor 255. As will be discussed in further detail below, the pitting filter module 275 can apply a flexible amount of filtering based on an application of a rule or according to some other criterion. For example, the digital signals from the pitting sensor 255 can receive a level of averaging, wherein the level varies according to tubing speed.

Figure 4:
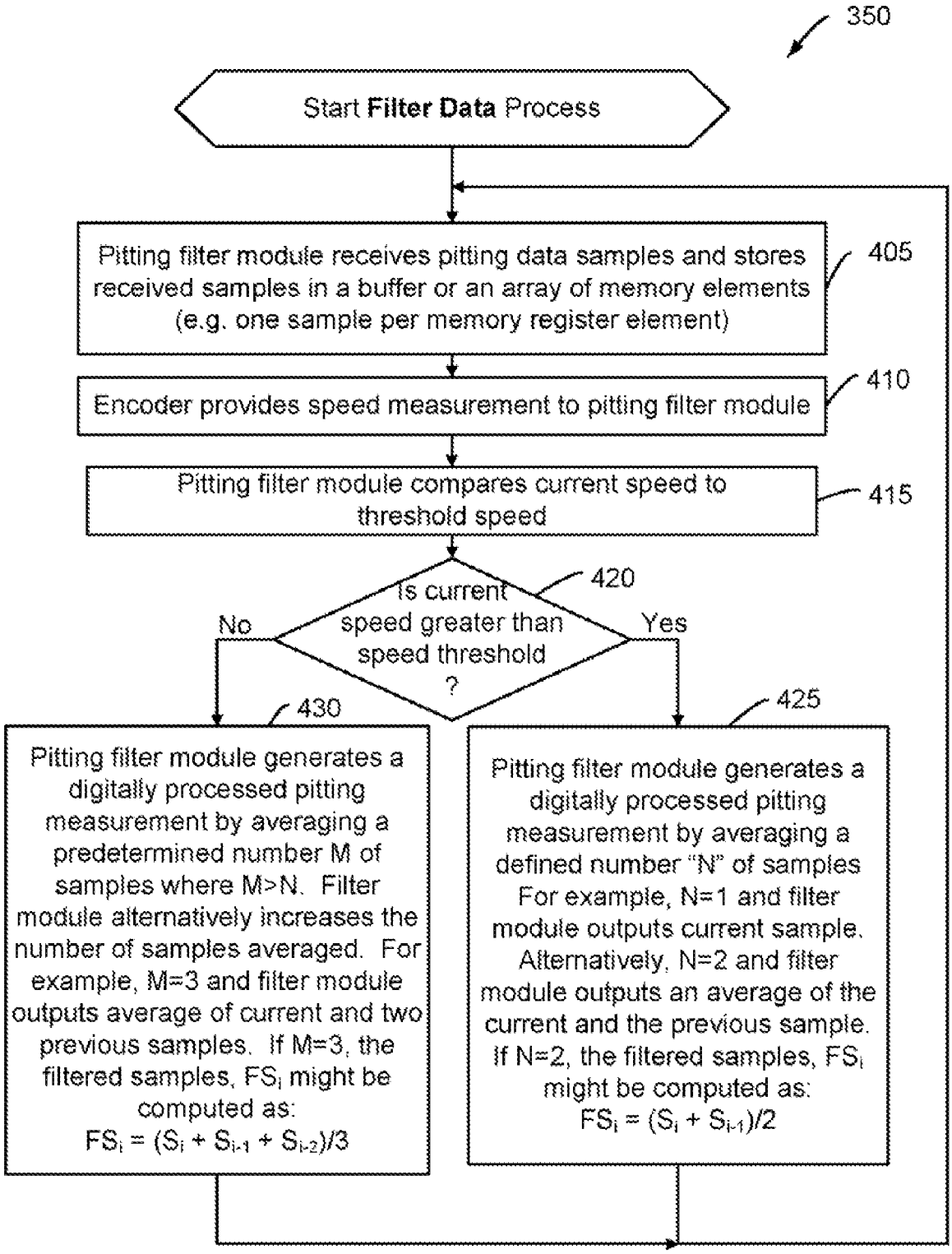
FIG. 4 is a flowchart of an exemplary process for filtering data that characterizes tubing in accordance with an embodiment of the present invention.

FIGS. 4 and 5 respectively present a flowchart and an accompanying dataset of an exemplary embodiment of Step 350, as Process 350, which is entitled Filter Data. In the exemplary embodiment of FIGS. 4 and 5, Process 350 conducts data processing in an iterative manner. More specifically and as discussed in further detail below, Process 350 typically runs or executes in parallel with and/or in coordination with certain other steps of Process 300. Thus, Process 300 avoids remaining "stuck" in the iterative loop of FIG. 4.

At Step 355, the tubing scanner 150 forwards the digitally processed tubing samples to the laptop 130. The laptop 130 displays the data, typically in the form of one or more graphs, plots, or trends, for the service crew's observation.

At Step 360, a member of the crew views and interprets the data displayed on the laptop 130. The operator, or an engineer or technician, typically grades or classifies each joint of extracted tubing according to pitting damage, wall thickness, and/or another factor. The operator may classify some tubing joints as unfit for continued service, while grading other sections of tubing 125 as marginal, and still others as having pristine condition. The operator may use a system of color codes, for example. In one exemplary embodiment, the grading is automatic, autonomous, or computer-implemented.

At inquiry Step 365, the service crew determines whether the current extraction increment completes the tubing's extraction from the well 175. More specifically, the operator may determine if the pump attached to the bottom of the tubing string 125 is near the wellhead. If all tubing joints have been removed, Process 300 ends. If tubing 125 remains downhole, Process 300 loops back to Step 340 and repeats Step 340 and the steps that follow. In that case, the service crew continues to extract tubing 125, and the tubing scanner 150 continues to evaluate the extracted tubing 125.

After servicing the pump and/or the well, the crew incrementally "makes up" and inserts the tubing string 125 into the well 175 to complete the service job. In one exemplary embodiment of the present invention, the tubing scanner 150 scans the tubing 125 while inserting the tubing 125 into the well 175, effectively conducting many of the steps of Process 300 in reverse. In one exemplary embodiment of the present invention, pitting and rod-wear data is collected while the tubing 125 moves uphole, and the tubing 125 is monitored for cracks as the tubing 125 moves downhole.

Turning now to FIGS. 4 and 5, FIG. 4 illustrates a flowchart of a process 350 for filtering data that characterizes tubing 125 according to an exemplary embodiment of the present invention. FIG. 5 illustrates a graphical plot 500 and an accompanying table 550 of raw data samples 555 and filtered data samples 560, 565 according to an exemplary embodiment of the present invention. As discussed above, FIGS. 4 and 5 illustrate an exemplary embodiment of Step 350 of Process 300.

Figures 5A, 5B:
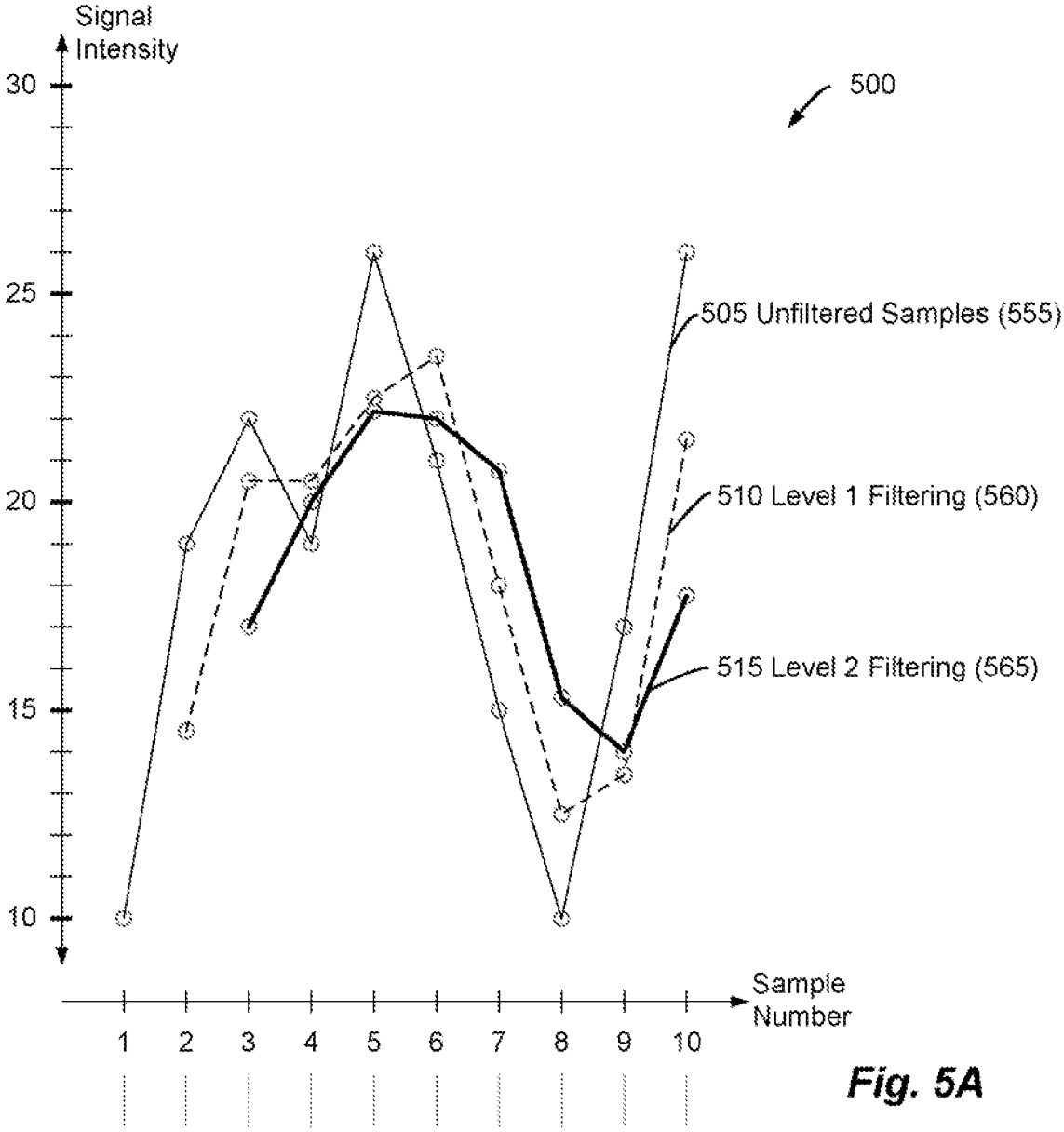
FIGS. 5A and 5B, collectively

At Step 405, the pitting filter module 275 begins processing the digital samples 555 that it received at Step 345 of Process 300. The table 550 of FIG. 5B provides simulated digital samples 555 as an example. The pitting filter module 275 places the samples 555 in a buffer, a memory array, or some other storage facility. For example, a memory device may hold one sample 555 per table cell or per memory register.

At Step 410, the encoder 115 measures the speed of the tubing 125 and outputs the speed measurement to the pitting filter module 275 via the communication link 120. Thus, the pitting filter module 275 has access to information about the speed of the tubing 125 throughout each extraction increment. As discussed above, the tubing's extraction speed may fluctuate, may change in an uncontrolled manner, or may be erratic.

At Step 415, the pitting filter module 275 compares the measured tubing speed to a speed threshold. The speed threshold can be a setting input by an operator, technician, or engineer via the laptop 130. Alternatively, the speed threshold can be software generated, for example derived from an assessment of the pitting sensor's performance and/or responsiveness. Moreover, the speed threshold can be determined empirically or based on a calibration procedure, a standardization process, a rule, or some protocol or procedure.

The flow of Process 350 branches at inquiry Step 420 according to whether the measured speed is greater that the speed threshold. If the measured speed is greater than the speed threshold, then Step 425 follows Step 420. If the measured speed is not greater than the speed threshold, then Step 430 follows Step 420. After executing one of Step 430 and 425, Process 350 loops back to Step 405 and continues digitally processing sensor samples 555. Step 430 applies a greater level of filtering or averaging than Step 425 applies.

Thus, at lower speeds, the pitting filter module 275 applies more filtering than it applies at higher speeds. In other words, the pitting filter module 275 applies greater smoothing or averaging in response to a tubing speed decrease or in response to the tubing speed dropping below a threshold or a limit.

As discussed above, Process 300 typically executes Step 350 without waiting for the flow of Process 350 to exit the iterative loop shown in FIG. 4. For example, Process 350 may run in the background, with Process 300 obtaining output from Process 350 on an as-needed basis. Moreover, Process 300 may stop and start Process 350, as Step 350, for example causing Process 350 to perform a predetermined number of iterative cycles or halting its execution after achieving some computational result.

In an alternative exemplary embodiment of the present invention, Step 420 is adapted, relative to the version illustrated on FIG. 4, to compare the current speed to a band or a range of speeds. If the current speed is above the band, then Step 425 follows Step 420 as a first filtering mode. If the current speed is below the band, then, Step 430 follows Step 425 as a second filtering mode. If the current speed is within the band, then Process 350 selects another step (not explicitly illustrated in the flowchart of FIG. 4) as a third filtering mode.

In one embodiment, that third filtering mode may alternatively provide a level of filtering somewhere between the filtering of the first mode and the filtering of the second mode. The third filtering mode can also comprise a refined filtering approach or a user-selected level of filtering, for example.

The third filtering mode may alternatively comprise the last filtering mode used prior to the speed entering the band. In other words, the speed band has an upper speed threshold at the top of the band and a lower speed threshold at the bottom of the band. If the current speed is greater than the upper speed threshold, the filter module 275 applies the first filtering mode. If the current speed then drops below the upper speed threshold without falling below the lower speed threshold, the filter module 275 continues applying the first filtering mode. If the current speed then drops below the lower threshold (from within the band), the filter module 275 applies the second filtering mode. If the speed then increases back into the band, the filter module 275 continues applying the second filtering mode until the speed increases above the band. Thus, in this embodiment, the filter module 275 can be viewed as using a "dead band" as a criterion for selecting a filtering mode or state.

Referring now to the flowchart FIG. 4, at Step 425, which executes in response to the tubing speed being above the speed threshold, the pitting filter module 275 applies a first level of filtering or averaging to the raw data 555. In one exemplary embodiment, the digital signal processing of Step 425 comprises averaging a number "N" of the samples 555. The number "N" may be set to one or two, for example.

For example, as shown in the table 550 of FIG. 5B, the pitting filter module 275 can average two of the samples 555 using the computation or equation shown immediately below. In this computation "$FS_i$" denotes the current filtered sample 560, "$S_i$" denotes the current raw sample 555, and "$S_{i-1}$" denotes the raw sample 555 acquired immediately before the current raw sample 555.

$$FS_i=(S_i+S_{i-1})/2$$

As shown in the plot 510 of the level-one-filtered data samples 560, the level-one filtering suppresses or smoothes some of the peaks present in the raw data plot 505, while retaining the raw data plot's general structure.

If the tubing 125 is moving rapidly, low filtering or no filtering may be appropriate. The motion of the tubing through the measurement zone 155 can, itself, smooth the data 555. In other words, in many circumstances, spikes present in raw data 555 obtained from a fast-moving tubing 125 can be attributable to valid tubing conditions, may be of interest to the operator, and may bear on grading the tubing 125.

At Step 430, which Process 350 executes in response to the tubing speed being below the speed threshold, the pitting filter module 275 applies a second, higher level of filtering or averaging to the raw data 555. In one exemplary embodiment, the digital signal processing of Step 430 comprises averaging a number "M" of the samples 555, wherein M is greater than N (M>N). The number "M" may be set to three, for example.

For example, as shown in the table 550 of FIG. 5B, the pitting filter module 275 can average three of the samples 555 using the following computation:

$$FS_i=(S_i+S_{i-1}+S_{i-2})/3$$

The symbols of this equation follow the same conventions of the equation of Step 425, discussed above. As shown in the plot 515 of the level-two-filtered data samples 565, the level-two filtering further suppresses or smoothes the peaks present in the raw data plot 505.

With the tubing string 125 moving very slowly or stopped, level-two suppression can suppress high-frequency components of the raw data 555. Such spikes could be attributed to noise, an extraneous effect, or some influence that is not directly related to grading the tubing 125. In one embodiment of the present invention, Process 350 applies a third level of suppression when the tubing string 125 is stopped. That third level can further smooth signal spikes, for example by setting M to five, ten, or twenty.

Process 350 may be viewed as an exemplary method for changing the filtering in response to a speed event or a noise event. While Process 350 provides two discrete levels of filtering, other exemplary embodiments may implement more filtering levels, such as three, ten, one hundred, etc. In one exemplary embodiment, the number of levels is large enough to approximate continuity, to be continuous, or to provide an essentially unlimited number of levels.

In one exemplary embodiment, Process 350 can be viewed as a rule-based method for digitally processing signals. Moreover, Process 350 can be viewed as a method for filtering the output of the pitting sensor 255 using two filtering modes, wherein a specific mode is selected based on an event related to signal integrity, fidelity, noise, or quality.

In one exemplary embodiment of the present invention, the motion of the tube 125 provides a first filtering or signal averaging, and the pitting filter module 275 provides a second filtering or signal averaging. Thus, the total filtering is the aggregate or net of the first filtering and the second filtering. A computer-based process can adjust that second filtering to offset or compensate for changes in the first filtering due to speed variations. In response to the computer adjustments of the second filtering, the net filtering may remain relatively constant or uniform despite fluctuations in tubing speed.

In one exemplary embodiment, the tubing scanner 150 flexibly filters sensor signals while the signals are in the analog domain. For example, the pitting sensor electronics 270 can comprise an adaptive filter that applies a variable amount of analog filtering to analog signals from the pitting transducer 260. That is, the sensor electronics 270 can process the analog pitting signal using a time constant that is set according to encoder input, speed, noise, or some other criterion, rule, or parameter. Accordingly, adaptive filtering can occur exclusively in the digital domain, exclusively in the analog domain, or in both the analog and the digital domain.

Figure 6:
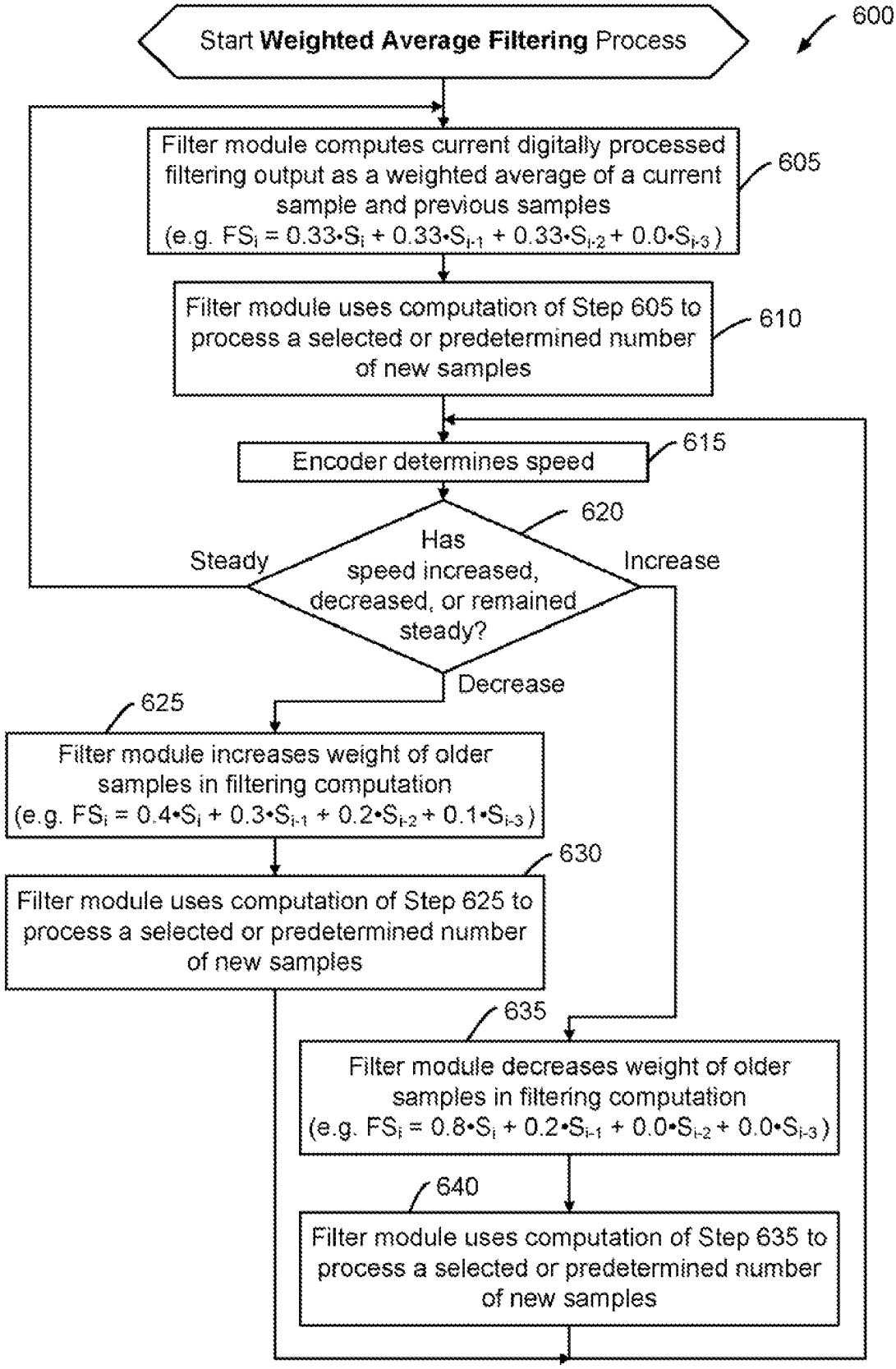
FIG. 6 is a flowchart of an exemplary process for filtering tubing data using an adaptive filter in accordance with an embodiment of the present invention.
Figures 7A, 7B:
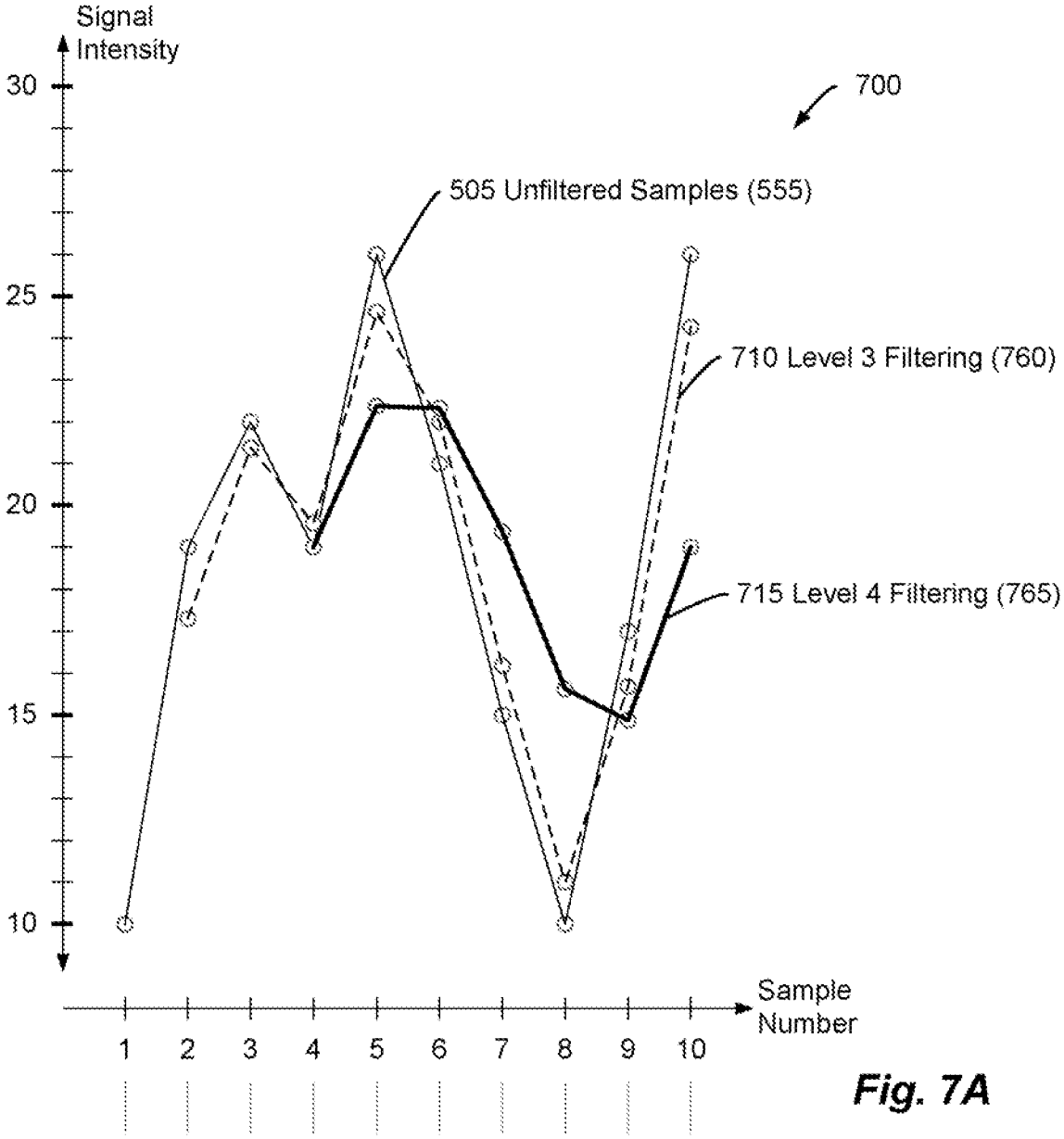
FIGS. 7A and 7B, collectively

Turning now to FIGS. 6 and 7, FIG. 6 illustrates a flowchart of a process 600 for filtering tubing data 555 using an adaptive filter according to an exemplary embodiment of the present invention. FIG. 7 illustrates a graphical plot 700 and an accompanying table 750 of raw tubing data 555 and adaptively filtered tubing data 760, 765 according to an exemplary embodiment of the present invention.

Although Process 600, which is entitled Weighted Average Filtering, will be discussed with exemplary reference to the pitting sensor 255, the method is applicable to the rod-wear sensor 205 or to some other sensing device that monitors tubing.

In one exemplary embodiment of the present invention, Process 600 can be implemented as Step 350 of Process 300, discussed above and illustrated in FIG. 3. That is, Process 300 can execute Process 600 as an alternative to executing Process 350 as illustrated in FIGS. 4 and 5 and discussed above.

Process 600 outputs filtered signal samples 565, 760, 765 that are each a weighted composite of four raw signal samples 755.

At Step 605, the pitting filter module 275 computes a current processed sample 565 as a weighted average of a present, or current sample and three earlier samples. That is, the output is based on the most recently acquired sample and the three immediately-preceding samples, wherein three is an exemplary rather than restrictive number of samples.

For example, the pitting filter module 275 can apply the following computation to the raw data 555 as a basis for generating each filtered sample output ($FS_i$) 565 in a series of outputs 565:

$$FS_i=0.33\cdot S_i+0.33\cdot S_{i-1}+0.33\cdot S_{i-2}+0.0\cdot S_{i-3}$$

In this equation, "$FS_i$" denotes the current filtered sample, "$S_i$" denotes the current raw sample 555, and "$S_{i-1}$," "$S_{i-2}$," and "$S_{i-3}$" denote the three samples 555 that arrive in series at the pitting filter module 275 in advance of the current sample 555. FIG. 5A, discussed above, provides a plot 515 and a data table 565 of the results of this equation. In other words, the computation of Step 430 of Process 350 provides an equivalent computation to the computation of Step 605 of Process 600.

At Step 610, the pitting filter module 275 uses the computation of Step 605 to produce a predetermined or a selected number of outputs, such as ten or one hundred, for example. Process 600 can implement Step 610 by iterating Step 605 a fixed number of times or for a fixed amount of time. In one exemplary embodiment of the present invention, Process 600 iterates Step 605 until an event occurs; until the signal exhibits a predetermined characteristic, such as a frequency content; or until a signal processing objective, such as a stabilization criterion, is met.

At Step 615, the encoder 115 determines the tubing speed and forwards that speed to the pitting filter module 275.

At inquiry Step 620, the pitting filter module 275 applies a rule to the tubing speed, specifically determining whether the speed has increased, decreased, or remained steady, for example for a period of time. The period of time can comprise a fixed time, a configurable time, or an amount of time that varies according to a rule.

Determining whether the speed remains steady can comprise determining whether the speed remains within a speed region or a band of acceptable speeds. That is, the determination of inquiry Step 620 can be based on whether the actual speed is between two levels or thresholds. The determination of Step 620 can further comprise evaluating whether the speed is uniform, constant, consistent, smooth, or within a band of normalcy, for example.

If the speed is steady, as determined at Step 620, Process 600 iterates Steps 605 610, 615, and 620 thereby using, or continuing to use, the equation of Step 605 to digitally process incoming sensor samples.

If the pitting filter module 275 determines that the speed has decreased rather than remained constant, then Process 600 executes Step 625 following Step 620. At Step 625, the filtering module 225 applies a filtering computation to the raw data 555 that increases the weight of older samples 555 or that includes a contribution of older samples 555. For example, the pitting filter module 275 may use the following computation:

$$FS_i=0.4\cdot S_i+0.3\cdot S_{i-1}+0.2\cdot S_{i-2}+0.1\cdot S_{i-3}$$

The results 765 of this equation are tabulated in table 750 and presented graphically via the trace 715 (arbitrarily labeled "Level 4 Filtering") of the plot 700. The symbols of this equation follow the same notational conventions of the equation of Step 605, discussed above.

At Step 630, the pitting filter module 275 generates multiple filtered output samples 765 using the computation of Step 625. The number of generated samples can be ten, fifty, one hundred, or one thousand, for example. Process 600 can iterate Step 625 to achieve Step 630. The number of iterations can be based on time, output, or a number of cycles. In one exemplary embodiment of the present invention, Process 600 iterates Step 625 until an event occurs, until the filtered signal exhibits a predetermined characteristic, such as a frequency content, or until meeting a signal processing objective, such as a stabilization criterion.

Following Step 630, Process 600 loops back to Step 615 to check the tubing speed and to inquire, at Step 620, whether the tubing speed is increasing, decreasing, or remaining constant.

If the pitting filter module 275 determines, at Step 620, that the tubing speed is increasing rather than decreasing or remaining constant, then Step 635 follows Step 620. At Step 635, the pitting filter module 275 increases the contribution of the more recent samples 555 in the filtering computation. For example, the pitting filter module 275 might apply the following computation to the raw data samples 555:

$$FS_i=0.8\cdot S_i+0.2\cdot S_{i-1}+0.0\cdot S_{i-2}+0.0\cdot S_{i-3}$$

The row 760 of the table 750 provides a representative output of this computation using the raw sensor data 555. The trace 710, arbitrarily labeled "Level 3 Filtering" shows the filtered data 760 in graphical form. This computation follows the same symbolic notation of the equations of Steps 605 and 625, which are discussed above.

At Step 640, the pitting filter module 275 applies the computation of Step 635 to the incoming data samples 555, executing at each new data element 555, to generate the filtered output samples 760. The pitting filter module 275 can generate either a fixed or a flexible number of filtered samples 760, such as ten, fifty, one hundred, ten thousand, etc. Process 600 can repeat or iteratively execute Step 635 to achieve Step 640. The number of iterations can be based on time or a number of cycles. In one exemplary embodiment of the present invention, Process 600 repeats Step 635 until an event occurs, or until the filtered signal exhibits a predetermined characteristic, such as a frequency content, or until meeting a signal processing objective, such as a stabilization criterion.

Following the execution of Step 640, Process 600 loops back to Step 615, obtains a fresh speed measurement, executes inquiry Step 620 to determine whether a speed change event has occurred, and proceeds accordingly.

Figure 8:
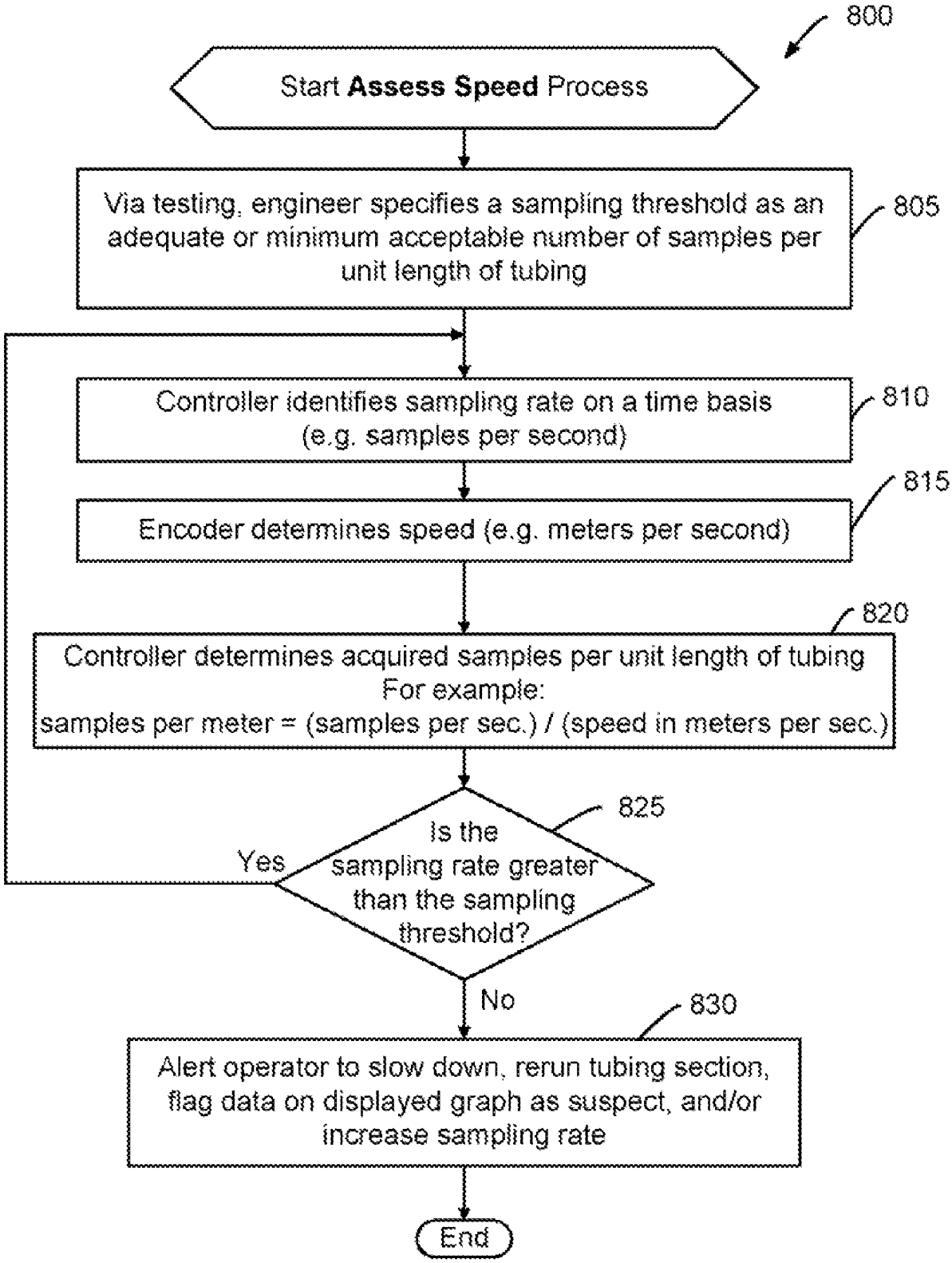
FIG. 8 is a flowchart of an exemplary process for evaluating a sampling rate of data obtained from a tubing sensor in accordance with an embodiment of the present invention.

Turning now to FIG. 8, this figure illustrates a flowchart of a process 800 for evaluating a sampling rate of data obtained from a tubing sensor according to an exemplary embodiment of the present invention. The tubing sensor can be the tubing scanner 150, the pitting sensor 255, the rod-wear sensor 205, a collar locator, an inventory counter, an imaging apparatus, or some other monitoring or evaluating device or detection system, for example.

Process 800, which is entitled Assess Speed, will be described in the exemplary situation of the controller 250 performing certain of the method's steps. However, in an alternative embodiment, software executing on the laptop 130 implements various steps of Process 800.

Moreover, the instrumentation system 200, which comprises the laptop 130 and the controller 250, can perform Process 800 as an adjunct, complement, or supplement to the adaptive filtering of Process 350 or Process 600. Alternatively, the instrumentation system 200 can perform Process 800, or a similar process, as an alternative to performing Process 350 or Process 600. Process 800 can proceed with or without the filter modules 225, 275 performing digital signal processing tasks.

At Step 805, an engineer or some other person, tests the system 200 on various tubes to identify the tubing scanner's performance characteristics at various tubing speeds. Test pieces of tubing can have assorted defects, pits, cracks, and rod-wear conditions that are representative of real-world situations. That is, the tubing scanner 150 can be characterized by scanning standard pieces of tubing 125 that, have well-defined defects. The testing can comprise moving tubes, each at a known stage of deterioration, at various speeds though the measurement zone 155 of the tubing scanner 150.

The engineer uses the empirical results of those tests to specify, define, or establish a sampling threshold for operating the tubing scanner 150. That is, the engineer specifies a minimum number of samples per unit length of tubing 125 that the tubing scanner 150 should acquire to obtain reliable or interpretable data. The engineer may also use the testing as a basis to specify a tubing speed limit, for example.

At Step 810, the controller 250 determines the actual sampling rate of the ADC 265 and the ADC 215. That is, during a routine service call, as illustrated in FIG. 1 and discussed above, the controller 250 determines the data sampling rate or data capture rate of the tubing scanner 200. The controller 250 may obtain this information by polling the ADCs 215, 265, or by measuring the passage of time between incoming samples, for example. The units of the sampling rate may be "samples per second," for example.

At Step 815, the encoder 115 measures the speed and provides the speed measurement to the controller 250.

At Step 820, the controller 250 determines the number of acquired samples that the ADCs 215, 265 are supplying on a length basis. That is, the controller 250 computes, based on the time between each sample and the speed of the tubing 125, how many samples that the tubing scanner 150 is producing in a given length of tubing 125.

Software executing on the controller 250 can compute the number of samples per meter of tubing as the sample rate (in samples per second) divided by the tubing speed (in meters per second). Thus, the controller 250 might employ the following equation to evaluate whether the tubing scanner 150 is generating a sufficient or adequate number of data samples per unit length of tubing:

$$\text{no. of samples per meter} = (\text{no. of samples per sec})/(\text{tubing speed in meters per sec.})$$

At inquiry Step 825, the controller 250 determines whether the actual, computed sampling rate is greater than the sampling threshold specified at Step 805. If the actual sampling rate is greater than the threshold, then at Step 825, Process 800 loops to Step 810. Thereafter, Process 800 continues monitoring the sampling rate to evaluate whether an adequate number of samples are being obtained from the tubing 125.

If the ADCs 215, 265 operate at a fixed sampling rate, then inquiry Step 825 can be viewed as assessing whether the tubing speed is within a range of acceptability.

If, at Step 825, the controller 250 determines that the tubing scanner is obtaining an insufficient number of samples of the tubing 125, then execution of Step 830 follows Step 825. At Step 830, the controller 250 takes corrective action to the under sampling condition. The controller 250 can alert the operator of the reel 110 to slow down. In one exemplary embodiment, the controller 250 automatically slows the rotational speed of the reel 110, for example via a feedback loop.

In one exemplary embodiment, the controller 250 may instruct the service crew to lower one or more sections of the tubing 125 back into the well 175, for example to re-scan a section from which an insufficient number of samples have been collected. Alternatively, the crew may elect to physically mark a section of the tubing 125 that has been identified as being associated with data of suspect quality. In one exemplary embodiment, the controller 250 sends notification to the laptop 130 that certain data is questionable or may not be reliable. The laptop 130 can mark the suspect data as potentially unreliable and can present a label on a graph of the data to highlight any suspect data. Moreover, a graphing capability, such as provided by the data management module discussed above, of the laptop 130 may overlay a confidence indicator upon the graphical data. The overlay may indicate the relative or absolute confidence of various portions of the graph according to the sampling rate.

In one exemplary embodiment of the present invention, the controller 250 sends a feedback signal to the ADCs 215, 265 upon an occurrence of a sampling rate incursion. That is, the controller 250 notifies the ADCs 215, 265 to increase their respective sampling rates if a section of tubing 125 is under sampled. The controller 250 can also increase the sampling rate of the ADCs 215, 265 if the number of samples per unit length is trending towards an unacceptable value.

Following Step 830, Process 800 ends. Process 800 can be viewed as a method for taking corrective action if the tubing scanner 150 fails to collect an adequate or sufficient number of measurement samples from a section of the tubing 125.

Figure 9:
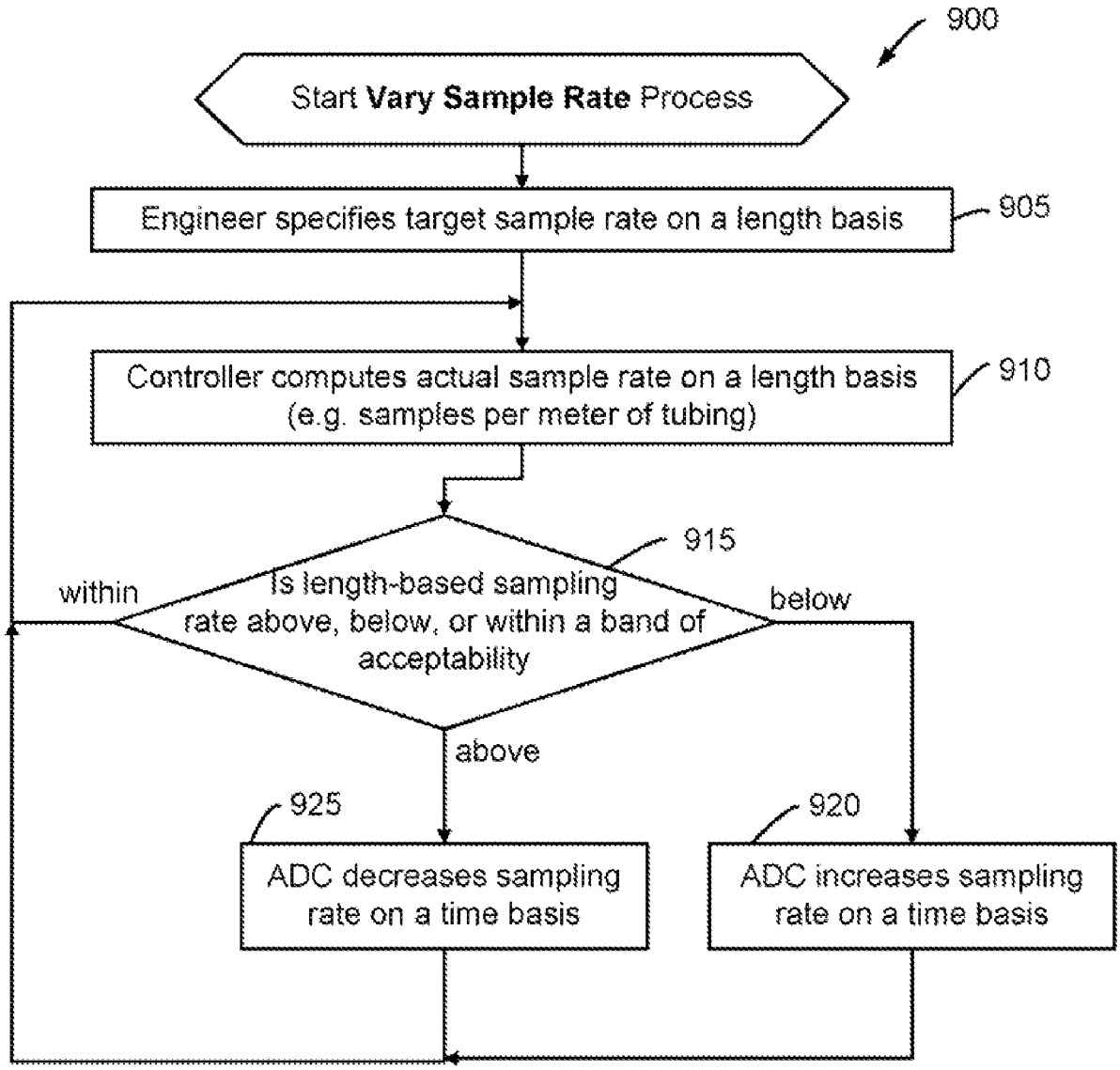
FIG. 9 is a flowchart of an exemplary process for varying a rate of obtaining data samples from a tubing sensor in accordance with an embodiment of the present invention.

Turning now to FIG. 9, this figure illustrates a flowchart of a process 900 for varying a rate of obtaining data samples from a tubing sensor according to an exemplary embodiment of the present invention. Process 900, which is entitled Vary Sample Rate, illustrates a method through which the tubing scanner 150 can adjust a rate of sample acquisition based on a rule or an application of a criterion.

At Step 905, an engineer specifies a target sampling rate on a length basis. As discussed above, the engineer can conduct testing to evaluate the number of samples that the tubing scanner 150 should collect from each unit length of the tubing 125 to ensure adequate data representation.

The analysis can proceed according to the principles of the Nyquist Theorem. In accordance with that theorem, the sampling should be greater than the Nyquist rate to avoid aliasing. In other words, the tubing 125 should be sampled at a frequency that is at least twice the frequency of any variation in the tubing 125 that may be relevant to evaluating or grading the tubing 125.

For example, if the tubing scanner 150 is to reliably detect tubing wall variations that are one millimeter in length and larger, then the minimum acceptable sampling rate might be specified as two samples per millimeter.

Moreover, the engineer may specify a band or range of acceptable sampling rates, wherein rates above or below the specified band are unacceptable. The sampling rate criterion can be based upon sensor resolution, for example to provide data with adequate resolution to discern features relative to a quality assessment.

At Step 910, the controller 250, or a software program executing thereon, computes the actual sampling rate on a length basis according to the time span between each sample and the speed of the tubing 125. The computation can proceed as discussed above with reference to Step 820 of Process 800, for example.

At inquiry Step 915, the controller 250 compares the actual length-based sampling rate, determined at Step 910, to the specifications defined at Step 905. Step 915 branches the flow of Process 900 according to whether the actual sampling rate is above, below, or within a range of acceptable values.

If the sampling rate is with the acceptable range, then Process 900 avoids altering the sampling rate and, via iterating Steps 910 and 915, continues monitoring the sampling rate to ensure that it remains within the acceptable range.

If the sampling rate is too low, then Process 900 executes Step 920. At Step 920, the controller 250 transmits a signal or command to either or both of the ADCs 215, 265. In response to that signal or command, the signaled ADC 215, 265 increases the sampling rate, typically by shortening the time between each sample acquisition.

If the controller 250 determines that the sampling rate is too high at Step 915, then execution of Step 925 follows execution of Step 915. At Step 915, the controller 250 signals the appropriate ADCs 215, 265 to decrease the sampling rate on a time basis. That is, one or both of the ADCs 215, 265 lengthen the time between each sample. One motivation to avoid an excessively high sampling rate is to conserve memory, computer processing resources, or communication bandwidth of the sampled data.

Following execution of either of Steps 920 and 925, Process 900 loops back to Step 910 and continues monitoring the sampling rate to ensure compliance with specifications or operating parameters.

In summary, an exemplary embodiment of the present invention can help provide information and/or operating conditions that aid in assessing whether a piece of tubing 125 is fit for continued oilfield service.

From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is to be limited only by any claims that may follow.

What is claimed is:

1. A method for evaluating tubing scan data from a tubing string comprising one or more tubing segments entering or being removed from a well, comprising:

moving at least one tubing segment into or out of the well;

scanning the tubing segments with at least one sensor at a plurality of time intervals to generate a plurality of tubing segment scan data values;

receiving the tubing segment scan data values;

receiving a current speed measurement;

comparing the current speed measurement to a predetermined speed threshold;

determining a number of tubing segment scan data values to include in a calculation of a weighted average tubing segment scan value based on the comparison of the speed measurement to a predetermined speed threshold;

calculating the weighted average tubing segment scan value; and displaying the weighted average tubing segment scan value on a visual display.

2. The method of claim 1 further comprising comparing the weighted average tubing segment scan value to a tubing segment calibration data set.

3. The method of claim 1 wherein the scanner comprising one of a wall thickness sensor, a rod-wear sensor, a crack imaging sensor, or a pitting sensor.

4. The method of claim 1, wherein the weighted average tubing segment scan value comprises a plurality of scan data of the sensor generated at distinct time intervals.

5. The method of claim 1, wherein the number of tubing segment scan data values to include in the calculation of the weighted average tubing segment scan value is greater if the current speed measurement is less than the predetermined speed threshold as compared to if the current speed measurement is greater than the predetermine speed threshold.

6. The method of claim 1, wherein the calculation of the weighted average tubing segment scan value comprises three tubing segment scan data values if the current speed measurement is less than the predetermined speed threshold.

7. A method for evaluating tubing scan data from a tubing string comprising one or more tubing segments entering or being removed from a well comprising the steps of:

accepting a predetermined sampling threshold level;

moving at least one tubing segment into or out of the well;

scanning the tubing segments with at least one sensor while the tubing segment is being moved into or out of the well;

receiving the tubing segment scan data;

determining a sampling rate for the tubing segment scan data;

receiving a current speed measurement for the tubing segment being moved into or out of the well;

determining a samples per unit length rate based on the sampling rate and the current speed measurement; and comparing the samples per unit length rate to the predetermined sampling threshold level.

8. The method of claim 7, further comprising the step of generating an alert if the samples per unit length rate is less than the sampling threshold level.

9. The method of claim 7, further comprising the step of increasing the sampling rate for the tubing segment scan data based on a determination that the samples per unit length rate is less than the sampling threshold level.

10. The method of claim 7, fun her comprising the steps of:

displaying the tubing segment scan data on a visual display at the wellsite; and generating a visual indicator comprising a notification that the tubing segment scan data is unreliable based on a determination that the samples per unit length rate is less than the sampling threshold level on the visual display.

11. The method of claim 7, further comprising the step of decreasing the speed the tubing segment is being moved into or out of the well based on a determination that the samples per unit length rate is less than the sampling threshold level.

12. The method of claim 7, further comprising the step of increasing the sampling rate based on a determination that the samples per unit length rate is less than the sampling threshold level.

13. A method for evaluating tubing scan data from a tubing string comprising one or more tubing segments entering or being removed from a well, comprising the steps of:

accepting a target sample rate;

moving at least one tubing segment into or out of the well;

scanning the tubing segments with at least one sensor while the tubing segment is being moved into or out of the well;

receiving a plurality of tubing segment scan data each comprising a sensor value and a time value;

receiving a speed value for tubing segment entering or being removed from the well;

determining a sampling rate per unit of length for the tubing segment scan data;

comparing the sampling rate per unit of length to the target sample rate.

14. The method of claim 13, wherein each tubing segment scan data comprises a tubing sensor value and a time value and wherein the method further comprises the step of receiving a speed value for the tubing segment entering or being removed from the well.

15. The method of claim 14, wherein the speed value is received from an encoder.

16. The method of claim 13, further comprising the step of decreasing the sampling rate per unit of length based on a determination that the sampling rate per unit of length is greater than the target sample rate.

17. The method of claim 13, further comprising the step of increasing the sampling rate per unit of length based on a determination that the sampling rate per unit of length is less than the target sample rate.

18. A method for evaluating tubing scan data from a tubing string comprising at least one tubing segment entering or being removed from a well, comprising the steps of:

scanning the tubing segments with at least one sensor;

receiving a plurality of tubing segment scan data, each tubing segment scan data comprising a sensor value;

receiving a first speed value;

accepting a first weighted average formula for calculating a first weighted sample based on at least a portion of the tubing segment scan data, wherein the formula comprises a plurality of successive sensor values and a plurality of weight values, each weight value associated with at least one of the successive sensor values;

calculating the first weighted sample based on the successive sensor values and the plurality of weight values;

receiving a second speed value;

determining if the second speed value is different than the first speed value;

modifying at least one of the plurality of weight values in the first weighted average formula create a second weighted average formula, based on a positive determination that the second speed value is different than the first speed value;

continue receiving the plurality of tubing segment scan data comprising the plurality successive sensor values; and calculating a second weighted sample with the second weighted average formula based on the plurality successive sensor value, wherein at least one sensor value in the second weighted average formula was received subsequent to the sensor values used to calculate the first weighted sample.

19. The method of claim 18, wherein the successive sensor values comprise at least one older sensor value and at least one newer sensor value, and wherein the weight value in the second weighted average formula for the older sensor value is decreased as compared to the first weighted average formula based on a determination that the second speed value is greater than the first speed value.

20. The method of claim 18, wherein the successive sensor values comprise at least one older sensor value and at least one newer sensor value, and wherein the weight value in the second weighted average formula for the older sensor value is increased as compared to the first weighted average formula based on a determination that the second speed value is less than the first speed value.

21. The method of claim 18, wherein the successive sensor values comprise at least one older sensor value and a plurality of subsequent sensor values, the subsequent sensor values being received after the older sensor value;

wherein the weight value in the second weighted average formula for the older sensor value is increased as compared to the weight value for the older sensor value in the first weighted average formula, based on a determination that the second speed value is less than the first speed value; and the weight value for at least one of the subsequent sensor values is reduced as compared to the weight values for the subsequent sensor values in the first weighted average formula, based on a determination that the second speed value is less than the first speed value.

22. The method of claim 18, wherein the successive sensor values comprise at least one older sensor value and a plurality of subsequent sensor values, the subsequent sensor values being received after the older sensor value;

wherein the weight value in the second weighted average formula for the older sensor value is decreased as compared to the weight value for the older sensor value in the first weighted average formula, based on a determination that the second speed value is greater than the first speed value; and the weight value for at least one of the subsequent sensor values is increased as compared to the weight values for the subsequent sensor values in the first weighted average formula, based on a determination that the second speed value is greater than the first speed value.

23. The method of claim 18, further comprising the steps of moving at least one tubing segment into or out of the well; and grading the tubing segment based on the second weighted sample.

* * * * *